United States Patent [19]

Li et al.

[11] Patent Number: 4,980,053

[45] Date of Patent: Dec. 25, 1990

[54] PRODUCTION OF GASEOUS OLEFINS BY CATALYTIC CONVERSION OF HYDROCARBONS

[75] Inventors: Zaiting Li; Shunhua Liu; Xingpin Ge, all of Beijing, China

[73] Assignee: Research Institute of Petroleum Processing, SINOPEC, Beijing, China

[21] Appl. No.: 405,576

[22] Filed: Sep. 11, 1989

Related U.S. Application Data

[63] Continuation of Ser. No. 229,500, Aug. 8, 1988, abandoned.

[30] Foreign Application Priority Data

Aug. 8, 1987 [CN] China ..... 87105428

[51] Int. Cl.[5] ..... C10G 11/05

[52] U.S. Cl. ..... 208/120; 585/651; 585/653

[58] Field of Search ..... 208/113, 120; 385/651, 385/653

[56] References Cited

U.S. PATENT DOCUMENTS 3,053,752 9/1962 Swanson ..... 208/78
3,290,405 12/1966 Rosenberg ..... 208/159
3,541,179 11/1970 Okagami et al. ..... 208/213
3,647,682 3/1972 Rabo et al. ..... 208/120
4,551,231 11/1985 Kovach et al. ..... 288/52 C T
4,717,466 1/1988 Herbst et al. ..... 208/113

*Primary Examiner*—Anthony McFarlane
*Attorney, Agent, or Firm*—Birch, Stewart, Kolasch & Birch

[57] ABSTRACT

Various fractions of petroleum, including residual oils and crude oils, are catalytically converted to produce gaseous olefins, especially propylene and butylene, in fluidized or moving bed or transfer line reactors with solid, acidic catalysts in the presence of steam at a temperature of 500° to 650° C. and a pressure of $1.5\times10^5$ Pa to $3\times10^5$ Pa, with a weight space velocity of 0.2 to 20 $hr^{-1}$ and catalyst-to-oil ratio of 2 to 12. Spent catalyst is continuously removed from the reactor to a regenerator where the coke is burned off and the hot catalyst is returned to the reactor. In a comparison with conventional catalytic cracking and tubular furnance pyrolysis processes, it is found that the process of the present invention produces more propylene and butylene. The total yield of the process of the present invention is about 40 percent by weight of the feedstock.

5 Claims, No Drawings

PRODUCTION OF GASEOUS OLEFINS BY CATALYTIC CONVERSION OF HYDROCARBONS

This application is a continuation of application Ser. No. 07/229,500, filed on Aug. 8, 1988, now abandoned.

BACKGROUND OF THE INVENTION

1. Field of the Invention

The present invention is related to the production of gaseous olefins, and most particularly to the production of propylene and butylene from petroleum hydrocarbons by catalytic conversion in which solid, acidic catalysts are used.

2. Discussion of Related Art

Ethylene, propylene, and butylene are produced conventionally from petroleum hydrocarbons, such as natural gas, naphtha or light gas oil by well known tubular furnance pyrolysis. They are also produced from heavy petroleum fractions by pyrolysis over heat carrier or by catalytic coversion of lower aliphatic alcohol. In modern refineries, gasoline and light gas oil are produced by conventional catalytic cracking, together with gaseous olefines as by-products at a yield of only less than 15 percent by weight of the feedstocks.

Recently, investigations for catalysts which are more effective for converting petroleum hydrocarbons to gaseous olefins have made and the results of the investigations have been reported in various patents. U.S. Pat. No. 3,541,179 discloses fluidized catalytic cracking process for producing gaseous olefins. The catalysts include copper, manganese, chromium, vanadium, zinc, silver, cadimum or their mixtures which are deposited on alumina or silica. U.S. Pat. No. 3,647,682 discloses the preparation of lower olefins from butane or middle distillate by catalytic cracking over a Y type zeolitic molecular seive. More recent patents in the same area include DD No. 152, 356 which describes a method for producing $C_2$ to $C_4$ olefins from gasoline or vacuum gas oil by a fixed or moving bed catalytic cracking over amorphous silica-alumina catalysts at a temperature of 600° to 800° C. and a contact time of for 0.3 to 0.7 seconds, with yields of 13.5% for ethylene, 6.3% for propylene and 10.5% for butylene. JP No. 60-222,428 discloses a process using the well known zeolite ZSM-5 as a catalyst and $C_5$ to $C_{25}$ paraffinic hydrocarbons as feed stock. The process is carried out at a reaction temperature of 600° to 750° C. and a space velocity of 20 to 300 per hour, with 30 percent yield for $C_2$ to $C_4$ olefins. When naphtha is used, the yields of ethylene, propylene, and butylene are 16, 14, and 1.8 percent, respectively. These above processes involve high cracking temperature, stringent requirement for material of cracking apparatus, and hydrocarbon feeds which are limited by a relatively narrow boiling ranges. The objectives of most of these processes aim are to obtain a higher production of ethylene.

OBJECTS OF THE INVENTION

The object of the present invention is to overcome the disadvantages which are related to the prior art and to provide a catalytic cracking process for the preparation of propylene and butylene with by-product distillate oils. Other objects and advantages will be more apparent in view of following detailed description.

SUMMARY OF THE INVENTION

In the process of the present invention, hydrocarbon feedstock is contacted with heated solid, acidic catalysts in a fluidized or moving bed or transfer line reactor and catalytically cracked, and then the reaction products and spent catalysts are drawn out from the reactor. After being stripped and separated from the reaction products, the spent catalyst having been deposited with coke is transferred to a regenerator where it is contacted with an oxygen containing gas at a high temperature and is regenerated by burning the coke deposited on the catalyst, and returning the calatyst to the reactor. $C_2$ to $C_4$ olefins, distillate oils, heavy oil and other saturated low hydrocarbons are obtained by the separation thereof from the reaction products.

DETAILED DESCRIPTION OF THE INVENTION

According to present invention, preheated hydrocarbon feedstock is cracked over heated catalyst in the reactor at temperatures from 500° C. to 650° C., preferably from 550° C. to 620° C. The weight hourly space velocity of the charge may range from about 0.2 to 20 $hr^{-1}$, preferably from about 1 to about 10 $hr^{-1}$. The catalysts-to-oil ratio may vary from 2 to 12, preferably from 5 to 10. In order to lower the partial pressure of hydrocarbon feed, steam or other gases, such as dry gas of catalytic cracking unit, may be added in the reactor during the conversion process. When steam is used, weight ratio of steam to hydrocarbon feed is maintained at about 0.01 to about 2:1. The total pressure of the reaction is from $1.5\times10^5$ Pa to $3\times10^5$ Pa, preferably from $1.5\times10^5$ Pa. to $2\times10^5$ Pa. The obtained gaseous products may be separated into ethylene, propylene, butylene, and other components, by using conventional techniques. Distilled liquid products include naphtha, light gas oil, heavy gas oil and decanted oil. By further separation, benzene, toluene, xylenes, heavy aromatics, naphthalene, and methyl naphthalennes are obtained.

After the reaction, the spent catalyst is stripped and hydrocarbons which are adsorbed on the catalyst are stripped by steam or other gases. The spent catalyst with coke deposited thereon is then transferred to a regeneration zone. Regeneration is conducted by contacting the catalyst with a oxygen-containing gas at a temperature of 650° C. to 750° C. Afterwards the regenerated catalyst is returned to the reaction zone and again used.

Hydrocarbon feedstocks in accordance with the present invention, which may vary in a wide range, and comprise of petroleum fractions with different boiling ranges, such as naphtha, distillate, vacuum gas oil, residual oil and the mixture thereof. Crude oil may also be directly used.

Catalysts used in the present invention are solid, acidic catalysts comprising one or more active components and a matrix material. The active components includes amorphous aluminosilicate or zeolites such as pentasil shape selective molecular sieves, faujasite, rare earth cation exchanged faujasite, chemically treated and/or stablized faujasite and mixtures thereof. The matrix material includes synthetic inorganic oxides and mineral clays. All of these catalysts are commerically available. The following table lists the trade names and some of the properties of these catalysts.

| Catalyst in examples | Trade name | $Al_2O_3$ % | $Na_2O$ % | $Fe_2O_3$ % | Ignition loss, % | Attrition index, % |
|---|---|---|---|---|---|---|
| A | CHO | >48 | <0.30 | <0.90 | <15 | <2.0 |
| B | ZCO | 28 | 0.25 | 0.40 | — | <2.0 |
| C | CHP | 50 | <0.30 | <0.90 | <15 | <3.0 |
| D | mixture* of B & C | — | — | — | — | — |
| E | LWCII | >12 | <0.05 | <0.13 | <13 | <2.6 |

*mixed ratio 1:1

In the table, CHO is pentasil shape selective molecular sieves and rare earth exchanged Y sieves (REY) containing catalyst, ZCO is ultrastable hydrogen Y sieve (USY) containing catalysts, CHP is pentasil shape selective molecular sieves supported on kaolinite and LWC II is amorphous aluminosilicate catalyst. CHO, ZCO and CHP are manufactured by Catalyst Works of Qilu Petrochemical Company, SINOPEC. LWC II is manufactured by Catalyst Works of Lanzhou Refinery, SINOPEC. According to present invention, the use of these catalysts results in higher yields for gaseous olefins, especially propylene and butylene, by enhancing a secondary cracking reaction, reducing a hydrogen transfer reaction and prolonging the contact time between the hydrocarbon feed and the catalysts.

The reaction temperature of the process of the present invention is lower than that of prior catalytic conversion processes for producing gaseous olefins and therefore, it is not necessary to use expensive alloy steel material for the apparatus. Besides, operating conditions employed, the catalysts used in the present invention are properly selected so that not only is selective cracking of the hydrocarbon feed for the production of olefins is enhanced, but the formation of coke is also reduced.

In a comparison with conventional catalytic cracking processes, the process of present invention provide a higher yield of gaseous olefins, especially propylene and butylene.

It is also possible to use the present invention process in established fluidized catalytic cracking units by employed the necessary modifications.

The following examples will serve to further illustrate the present invention. These examples are to be considered illustrative only, and are not to be construed as limiting the scope of this invention.

EXAMPLE 1

This example illustrates the cracking of hydrocarbons over different solid, acidic catalysts.

Vacuum gas oil boiling from 350° C. to 540° C. with specific gravity 0.8730 was catalytically cracked on a bench-scale fluidized cracking unit. The reactions were conducted at 580° C., weight hourly space velocity of 1, catalyst to oil ratio of 5, and steam to hydrocarbon ratio of 0.3. From the results shown in Table 1, the yields of gaseous olefins over catalyst C and D are higher than the others.

TABLE 1

| Catalysts | A | B | C | D |
|---|---|---|---|---|
| yields, wt % (based on the feed oil) | | | | |
| Cracked gas | 52.0 | 51.2 | 54.0 | 55.6 |
| ethylene | 3.04 | 3.10 | 5.89 | 5.23 |
| propylene | 11.61 | 17.39 | 21.56 | 21.61 |
| butylene | 15.64 | 14.47 | 15.64 | 15.09 |
| $C_5$-205° C. fraction | 31.0 | 33.1 | 27.0 | 27.5 |

TABLE 1-continued

| Catalysts | A | B | C | D |
|---|---|---|---|---|
| 205-330° C. fraction | 5.2 | 6.4 | 6.8 | 7.0 |
| >330° C. | 1.5 | 3.3 | 5.6 | 3.9 |
| Coke | 10.3 | 6.0 | 6.6 | 6.0 |
| Conversion, wt %* | 93.3 | 90.3 | 87.6 | 89.1 |
| Ethylene + propylene + butylene, wt % | 30.17 | 35.05 | 43.09 | 41.93 |

*Note: conversion is calculated in terms of cracked gas, gasoline, coke and the loss (wt %)

EXAMPLE 2

This example illustrates the cracking of hydrocarbons under reaction temperature of 580° and 618° C. Hydrocarbon feed is the same vacuum gas oil as in Example 1, but the test was carried out on a dense phase transfer line reactor pilot plant. The spent catalyst is transported into a generator where coke is burned with air in a dense phase fluid bed. Catalyst C was used in this test. Small amount of nitrogen instead of steam was added to promote the atomization of hydrocarbon feed. The small increase of gaseous olefins obtained at 618° C. is shown in Table 2, but a slight decrease of liquid yield is also observed.

TABLE 2

| Reaction temperature, °C. | 580 | 618 |
|---|---|---|
| Weight hourly space velocity | 3.9 | 4.1 |
| Catalyst to oil ratio | 9.4 | 8.5 |
| Product yield, wt % | | |
| Cracked gas | 55.92 | 59.7 |
| Hydrogen | 0.56 | |
| Methane | 2.04 | |
| Ethane | 1.10 | |
| Ethylene | 6.0 | 7.37 |
| Propane | 2.37 | |
| Propylene | 24.6 | 26.34 |
| Propyne | 0.16 | |
| i-Butane | 1.66 | |
| n-Butane | 0.87 | 17.0 |
| 1-Butylene | 2.94 | |
| i-Butylene | 6.44 | |
| t-2-Butylene | 4.03 | |
| c-2-Butylene | 3.04 | |
| 1,3-Butadiene | 0.11 | |
| $C_5$-205° C. fraction | 22.38 | 19.5 |
| 205-330° C. fraction | 7.3 | 6.8 |
| >330°C. | 7.4 | 6.3 |
| Coke | 5.9 | 7.1 |
| Loss | 1.1 | 0.6 |
| Ethylene + Propylene + Butylene, wt % | 47.16 | 50.71 |

Compositions and octane number of $C_5$-205° C. gasoline fraction, obtained under reaction temperature of 580° C., are shown in Table 3.

TABLE 3

| | wt % in gasoline fraction |
|---|---|
| Saturated hydrocarbons | 10.64 |
| Olefinic hydrocarbons | 38.90 |
| Aromatic hydrocarbons | 50.46 |

TABLE 3-continued

| | wt % in gasoline fraction |
|---|---|
| Benzene | 3.37 |
| Toluene | 12.14 |
| Ethyl benzene | 2.16 |
| m-,p-Xylene | 11.00 |
| o-Xylene | 3.69 |
| m-,p-Methyl-ethyl-benzene | 3.39 |
| 1,3,5-Trimethyl-benzene | 1.58 |
| o-Methyl-ethyl-benzene | 0.77 |
| 1,3,4-Trimethyl-benzene | 5.57 |
| other heavy aromatics | 6.79 |
| Octane number (motor method) | 84.6 |

EXAMPLE 3

This example illustrates that feedstocks with different boiling ranges can be used to produce gaseous olefins.

TABLE 4

| | straight-run gasoline | straight run light gas oil | Vacuum gas oil | vacuum gas oil blended with equivalent residual oil |
|---|---|---|---|---|
| Specific gravity of Feedstock | — | 0.8098 | 0.873 | 0.8823 |
| boiling range, °C. | — | 210–330 | 350–540 | — |
| Catalyst | E | D | D | D |
| Apparatus of reaction | | Bench-scale fluidized bed | | |
| Weight hourly space velocity | 1.0 | 0.7 | 1.0 | 1.1 |
| Reaction temperature, °C. | 650 | 580 | 580 | 580 |
| Product yield, wt % | | | | |
| Cracked gas | 49.5 | 38.71 | 55.20 | 52.50 |
| Ethylene | 9.5 | 4.13 | 4.52 | 4.49 |
| Propylene | 13.3 | 14.01 | 21.31 | 20.34 |
| Butylene | 7.4 | 8.96 | 15.90 | 15.20 |
| $C_5$-205° C. fraction | 44.9 | 30.06 | 29.00 | 28.08 |
| 205–330° C. fraction | — | 27.50 | 5.60 | 6.70 |
| >330 ° C. | — | 1.48 | 5.18 | 5.28 |
| Coke | 5.6 | 2.25 | 5.02 | 7.44 |
| Conversion, wt % | — | 71.02 | 89.22 | 88.02 |
| Ethylene + propylene + butylene, wt % | 30.2 | 27.10 | 41.73 | 40.03 |

EXAMPLE 4

This example illustrates that distillates derived from various crude oils can be used as feedstock in the process of this invention. By using catalyst C, the reaction was carried out at the temperature of 580° C. on a dense phase transfer line reactor as in example 2. Results listed in Table 5 showed that when vacuum gas oil derived from paraffinic crude is used, the olefin yield is higher than that derived from intermediate base crude.

TABLE 5

| | VGO of paraffinic crude | VGO of intermediate base crude |
|---|---|---|
| Feedstock, specific gravity | 0.873 | 0.8655 |
| boiling range, °C. | 350–450 | 210–480 |
| UOP K Factor | 12.4 | 12.1 |
| Weight hourly space velocity | 3.9 | 3.4 |
| Product yield, wt % | | |
| Cracked gas | 55.92 | 47.55 |
| Ethylene | 6.00 | 5.30 |
| Propylene | 24.76 | 21.26 |
| Butylene | 16.56 | 14.21 |
| $C_5$-205° C. fraction | 22.38 | 18.75 |
| 205–330° C. fraction | 7.30 | 15.80 |
| >330° C. | 7.40 | 10.0 |
| Coke | 5.90 | 7.6 |
| Conversion, wt % | 85.3 | 74.2 |
| Ethylene + propylene + butylene, wt % | 47.32 | 40.77 |

TABLE 5-continued

| | VGO of paraffinic crude | VGO of intermediate base crude |
|---|---|---|
| wt % | | |

EXAMPLE 5

This example illustrates that crude oil can be used as feedstock directly in the process of the present invention.

TABLE 6

| | Paraffinic crude oil |
|---|---|
| Specific gravity of feedstock | 0.862 |
| Catalyst used | D |
| Reaction apparatus | bench-scale fluidized bed |
| Weight hourly space velocity | 1.0 |
| Reaction temperature, °C. | 580 |
| Product yield, wt % | |
| Cracked gas | 46.6 |
| Ethylene | 4.3 |
| Propylene | 17.8 |
| Butylene | 12.7 |
| $C_5$-205° C. fraction | 31.2 |
| 205–330° C. fraction | 10.4 |
| >330° C. | 3.5 |
| Coke | 8.3 |
| Ethylene + propylene + butylene, wt % | 34.8 |

EXAMPLE 6

This example illustrates product yield is varied with different reaction temperature, space velocity, and the amount of stream injected. VGO feedstock is the same as in Example 1. A bench-scale fixed fluidized catalytic cracking unit and catalyst D are used.

TABLE 7

| | | | |
|---|---|---|---|
| Reaction temperature, °C. | 540 | 580 | 600 |
| Weight hourly space velocity | 0.5 | 1.1 | 19 |
| Amount of steam/oil, wt. | 0.55 | 1.88 | 0.02 |
| Product yield, wt % | | | |
| Cracked gas | 52.8 | 56.1 | 44.6 |
| Ethylene | 4.2 | 4.3 | 3.2 |
| Propylene | 19.9 | 24.6 | 16.9 |

TABLE 7-continued

| | | | |
|---|---|---|---|
| Butylene | 14.7 | 18.7 | 14.1 |
| $C_5$-205° C. fraction | 29.7 | 29.0 | 32.3 |
| 205–330° C. fraction | 6.9 | 6.2 | 10.0 |
| >330° C. | 4.7 | 5.3 | 8.9 |
| Coke | 5.9 | 3.4 | 4.2 |
| Conversion, wt % | 88.4 | 88.5 | 81.1 |
| Ethylene + propylene + butylene, wt % | 38.8 | 47.6 | 34.2 |

We claim:

1. A process for preparing propylene and butylene by catalytic conversion under cracking conditions which comprises contacting petroleum hydrocarbon vacuum gas oil feedstock with a solid, acidic catalyst selected from the group consisting of pentasil shape selective molecular sieves, ultrastable hydrogen Y sieves, and a mixture of ultrastable hydrogen Y sieves and pentasil shape selective molecular sieves, in a fluidized or moving bed or dense phase transfer line reactor, in the presence of steam at a temperature in the range of from 500° C. to 650° C. and a pressure in the range of from $1.5\times10^5$ Pa. to $3.0\times10^5$ Pa., with a weight hourly space velocity of 0.2 to 20 $hr^{-1}$, a catalyst-to-oil ratio of 2 to 12, and steam-to-feedstock ratio of 0.01 to 2:1 by weight, thereby converting the petroleum hydrocarbon vacuum gas oil feedstock to propylene and butylene, wherein the propylene yield is over 15 wt. %, and the butylene yield is about 15 wt. %, each of the yields is based on the feedstock.

2. The process of claim 1, wherein said catalytic conversion is carried out at a temperature in the range of from 550° C. to 620° C., a pressure in the range of from $1.5\times10^5$ Pa. to $2.0\times10^5$ Pa. and a weight hourly space velocity of 1 to 10 $hr^{-1}$.

3. The process of claim 1, which further comprises stripping and regenerating the catalyst after the catalytic conversion, at a temperature in the range of from 650° C. to 750° C., in the presence of an oxygen-containing gas and returning the stripped and regenerated catalyst to the reactor for reuse.

4. The process of claim 1, wherein the steam-to-feedstock ratio is 0.05 to 1:1 by weight.

5. A process according to claim 1 wherein the pentasil shape selective molecular sieves are supported on kaolinite.

* * * * *